US011174643B2

(12) United States Patent
Oddy

(10) Patent No.: US 11,174,643 B2
(45) Date of Patent: Nov. 16, 2021

(54) METAL ROOF FLASHING SYSTEM

(71) Applicant: Ryan Edward Oddy, Miles City, MT (US)

(72) Inventor: Ryan Edward Oddy, Miles City, MT (US)

( * ) Notice: Subject to any disclaimer, the term of this patent is extended or adjusted under 35 U.S.C. 154(b) by 0 days.

(21) Appl. No.: 16/275,282

(22) Filed: Feb. 13, 2019

(65) Prior Publication Data

US 2019/0249438 A1 Aug. 15, 2019

Related U.S. Application Data

(60) Provisional application No. 62/630,062, filed on Feb. 13, 2018.

(51) Int. Cl.
*E04D 13/147* (2006.01)
*E04D 13/14* (2006.01)

(52) U.S. Cl.
CPC ..... *E04D 13/1473* (2013.01); *E04D 13/1407* (2013.01)

(58) Field of Classification Search
CPC ..... E04D 13/1476; E04D 13/1473; E04D 13/1407; E04D 13/147
See application file for complete search history.

(56) References Cited

U.S. PATENT DOCUMENTS 1,317,574 A * 9/1919 Grosvold ..... E04D 13/1471 285/44
1,615,929 A * 2/1927 Buckles ..... E04D 13/1476 285/43
1,678,715 A * 7/1928 Stephenson ..... E04D 13/1476 285/44
3,313,559 A * 4/1967 Kifer ..... E04D 13/1476 285/43
3,871,145 A 3/1975 Hatmaker
6,620,271 B2 9/2003 Mayle et al.
8,397,438 B2 * 3/2013 Hoy ..... E04D 13/1476 285/43
8,484,914 B2 * 7/2013 Cline ..... E04D 13/1476 52/219
8,490,351 B1 * 7/2013 Scott ..... E04D 13/1476 285/42
9,181,705 B2 11/2015 Lanza
9,228,689 B1 * 1/2016 Cline ..... F24F 7/02
10,041,688 B1 * 8/2018 Droppo ..... F24D 19/08
10,151,112 B2 * 12/2018 Lechuga ..... E04C 2/52
2003/0066254 A1 * 4/2003 DeBlock ..... E04D 13/1476 52/200
2009/0013620 A1 * 1/2009 West ..... E04D 13/1476 52/198
2011/0120047 A1 * 5/2011 Stearns ..... F16B 43/001 52/698
2018/0097470 A1 * 4/2018 Truthseeker ..... E04D 13/1473

* cited by examiner

*Primary Examiner* — Christine T Cajilig
(74) *Attorney, Agent, or Firm* — Michael C. Balaguy

(57) ABSTRACT

A metal roof flashing system includes a pipe flashing assembly including a triangular base flashing, a rubber vent support, and a lower flashing seal. The pipe flashing assembly is structured to receive a roof vent pipe and form a watertight seal around a plumbing vent stack on a roof surface or side wall of a building. The rubber vent support is flexible and contours to and around the roof vent pipe and form a seal. The pipe flashing assembly is able to be installed on a metal roof surface of a building.

18 Claims, 5 Drawing Sheets

METAL ROOF FLASHING SYSTEM

CROSS REFERENCE TO RELATED APPLICATION

The present application is related to and claims priority to U.S. Provisional Patent Application No. 62/630,062 filed Feb. 13, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Field of the Invention

The present invention relates generally to the field of flashing and more specifically relates to a flashing system for roof.

Description of Related Art

Many individuals in modern society live and/or work in buildings. Vents may be necessary for venting different appliances or plumbing systems. Vent stacks may be installed on a roof or sidewall area on a home or other building. Excess water can run down into the building through the vent stack, leading to costly repairs. Vent stacks are often very noticeable and can be eyesores when using metal roofing panels. A suitable solution is desired.

U.S. Pat. No. 8,397,438 to Mike Hoy relates to flashing boots for roof penetrations. The described flashing boots for roof penetrations includes flashing systems for use with metal and non-metal roof systems having a generally planar lead base defining an aperture, a generally cylindrical structure attached to the base in surrounding relation with the aperture and projecting upward therefrom, and an adhesive sealing membrane attached to the bottom of the base for connecting the flashing to a roof. A flexible plastic downspout allows flashing system to adapt to various roof slope and roof penetration configurations. The downspout may include a plurality of diametrically reducing stepped sections such that the installing technician is able to simply cut the stepped plastic downspout to the size that will accommodate the roof penetration pipe.

BRIEF SUMMARY OF THE INVENTION

In view of the foregoing disadvantages inherent in the known flashing art, the present disclosure provides a novel metal roof flashing system. The general purpose of the present disclosure, which will be described subsequently in greater detail, is to provide a residential or commercial pipe flashing used for providing a watertight seal around all plumbing vent stacks on a roof or sidewall.

A metal roof flashing system is disclosed herein. The metal roof flashing system includes a pipe flashing assembly including a triangular base flashing, a rubber vent support, and a lower flashing seal. The lower flashing seal is affixed to the triangular base flashing and the rubber vent support is affixed to the triangular base in respective order. The pipe flashing assembly is configured to receive a roof vent pipe and form a watertight seal around a plumbing vent stack on a roof surface. An aperture of the rubber vent support is flexible and is configured to contour to and around the roof vent pipe and form a seal. The pipe flashing assembly is configured to be installed on the roof surface or side wall of a building, in particular, a metal roof. The triangular base flashing and the lower flashing seal comprise a metal material. The device is provided to prevent leaks within a home or other building.

A method of installing a metal roof flashing system is also described herein including the steps of providing a pipe flashing assembly including a triangular base flashing, a rubber vent support, and a lower flashing seal; tracing a profile of the triangular base flashing on a roof covering; cutting a traced profile from the roof covering; mounting the pipe flashing assembly to a roof surface; placing a metal panel over the pipe flashing assembly; and sealing the metal panel to the pipe flashing assembly.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a metal roof flashing system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to flashing and more particularly to a metal roof flashing system as used to improve the flashing of roofs.

Generally, the present invention provides users with a residential or commercial pipe flashing used suitably for providing an effectively watertight seal around virtually all plumbing vent stacks on a roof or sidewall. It preferably includes a triangular base with a rubber conical vent support and lower flashing seal capable of being applied to the roof or sidewall in order to prevent water backup or flow beneath the surface. It prevents leaks and costly repairs within a home, office, etc. As designed, it reduces the visibility of flashing vent stacks and thus functionally improves the look and durability of a home or other building. The present invention can be made in numerous sizes and configurations to accommodate virtually any roof (slope) or sidewall area. The triangular base can be laid over the surface and traced for modular installation. After suitable cuts are made, the system can be installed over the hole and sealed. The system is intended to form a watertight seal around all plumbing vent stacks. The system can be constructed using rubber, metal, and other suitable materials. The flashings can be available in various sizes in order to accommodate all user needs and preferences. Exact size, measurement, construction, and design specifications may vary upon manufacturing.

Figure 1:
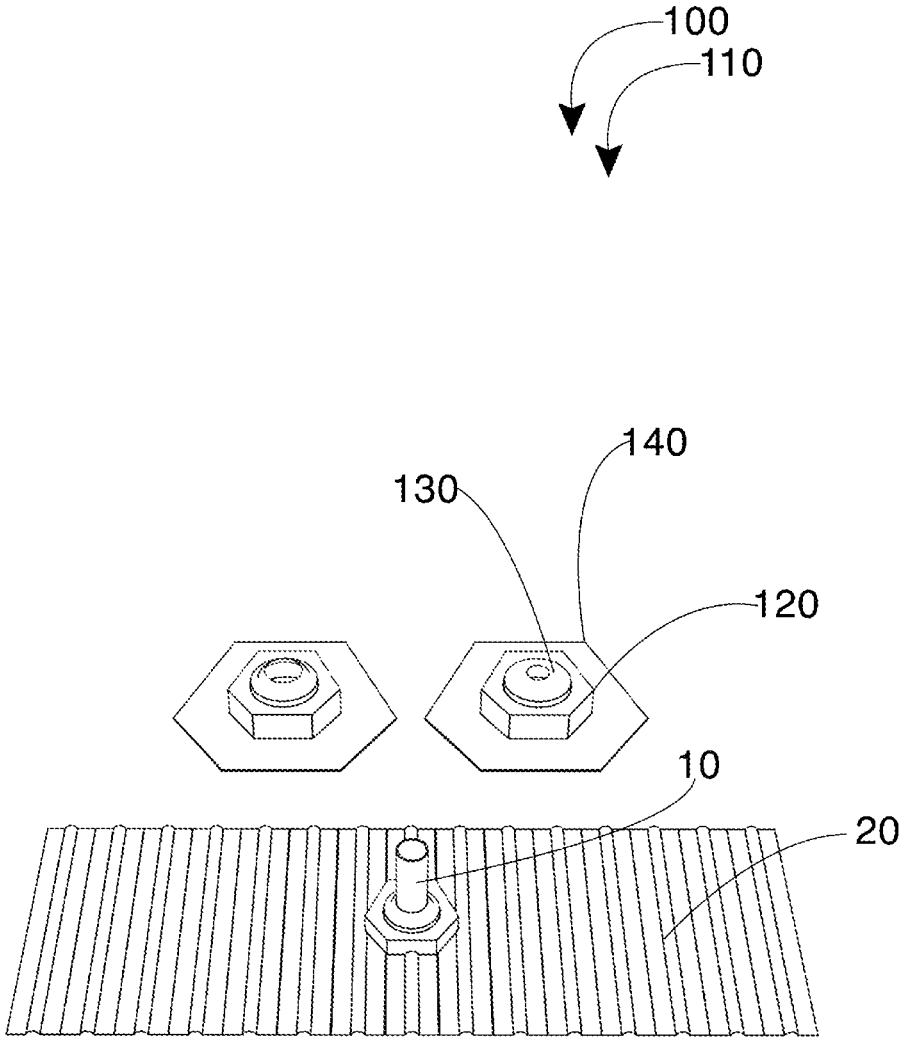
FIG. 1 is a perspective view of the metal roof flashing system, according to an embodiment of the disclosure.

Referring now more specifically to the drawings by numerals of reference, there is shown in FIGS. 1-5, various views of a metal roof flashing system 100. FIG. 1 shows a metal roof flashing system 100, according to an embodiment of the present disclosure. As illustrated, the metal roof flashing system 100 may include a pipe flashing assembly 110 including a triangular base flashing 120, a rubber vent support 130, and a lower flashing seal 140. The lower flashing seal 140 is affixed to the triangular base flashing 120 and the rubber vent support 130 is affixed to the triangular base flashing 120 in respective order. The pipe flashing assembly 110 is configured to receive a roof vent pipe 10 and form a watertight seal around a plumbing vent stack on a roof surface 20. An aperture 132 of the rubber vent support 130 is flexible and configured to contour to and around the roof vent pipe 10 and form a 'seal' (sealing means). The pipe flashing assembly 110 is configured to be installed on the roof surface 20 of a building and prevent leaks from occurring.

Figure 2:
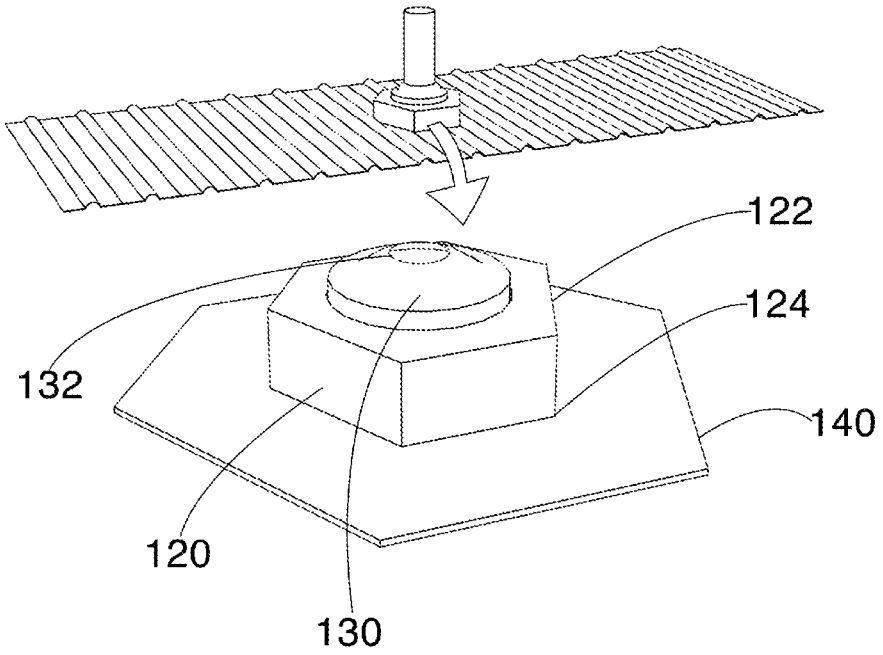
FIG. 2 is a perspective view of the metal roof flashing system of FIG. 1, according to an embodiment of the present disclosure.

FIG. 2 shows a perspective view of the metal roof flashing system 100 of FIG. 1, according to an embodiment of the present disclosure. As above, the metal roof flashing system 100 may include the pipe flashing assembly 110 including the triangular base flashing 120, the rubber vent support 130, and the lower flashing seal 140. The rubber vent support 130 comprises a conical profile and is positioned at a top edge 122 of the triangular base flashing 120. The lower flashing seal 140 is affixed to a bottom edge 124 of the triangular base flashing 120, opposing the rubber vent support 130. The lower flashing seal 140 comprises a larger surface area than a base-surface-area of the triangular base flashing 120 and extends outwardly from the bottom edge 124 of the triangular base flashing 120. As illustrated, the lower flashing seal 140 has three edges, and where any two of the three edges meet, they are connected by a diagonal which forms a flat-chamfered corner between the two meeting edges. Accordingly, lower flashing seal 140 includes three flat-chamfered corners.

Figure 3:
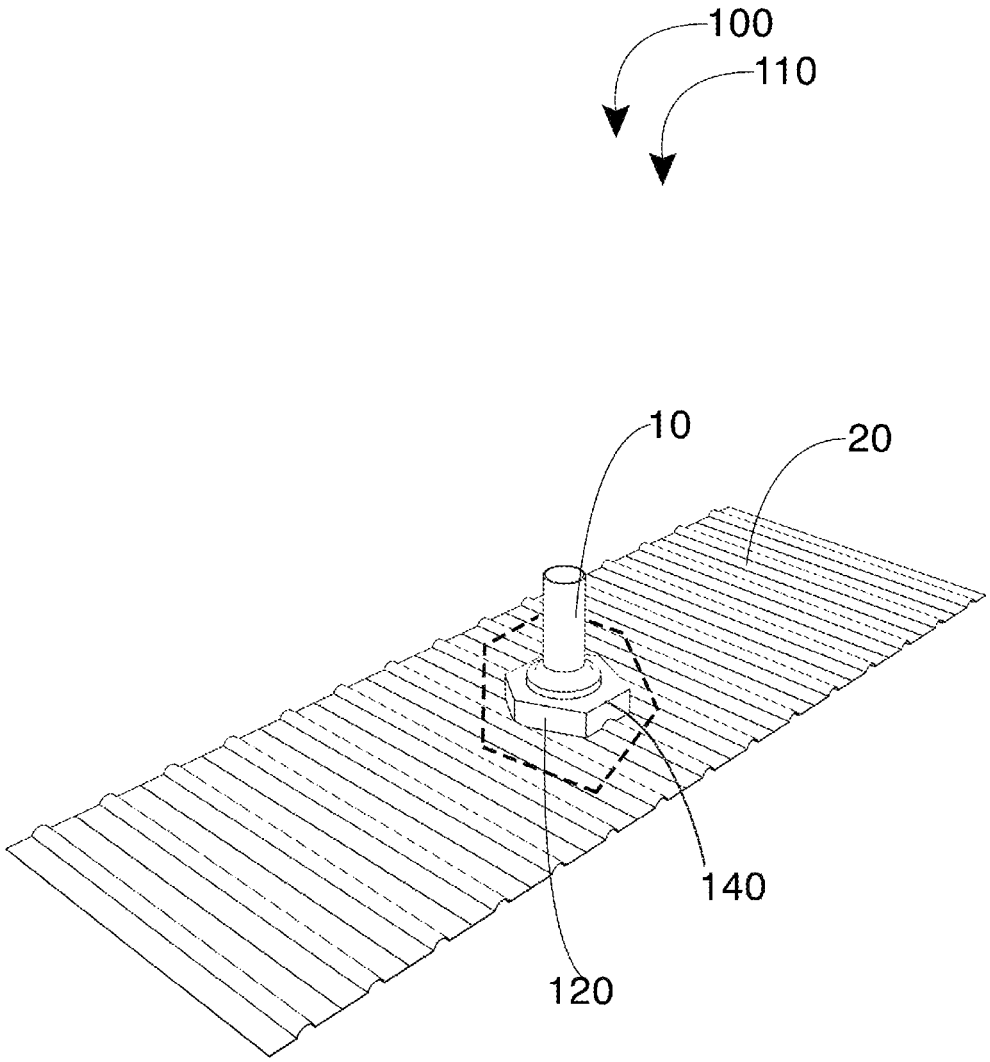
FIG. 3 is a perspective view of the metal roof flashing system of FIG. 1, according to an embodiment of the present disclosure.

FIG. 3 shows a perspective view of the metal roof flashing system 100 of FIG. 1, according to an embodiment of the present disclosure. As above, the metal roof flashing system 100 may include the pipe flashing assembly 110 which is configured seal roof vent pipes on a roof surface 20 of a metal roof or other surfaces of a building. The triangular base flashing 120 of the pipe flashing assembly 110 comprises a base-aperture or otherwise open section in line with the aperture 132 of the rubber vent support 130. The rubber vent support 130 is supported in an elevated position via the triangular base flashing 120. The rubber vent support 130 is deformable allowing the aperture 132 to stretch and be applied to the roof vent pipe 10. The rubber vent support 130 is an integral vent collar. In a preferred embodiment, the triangular (or other shape) base flashing 120 comprises a metal material. The lower flashing seal 140 is planar such that it may be installed in a flat, flush position against a roof surface 20. The lower flashing seal 140 also comprises a metal material. In other embodiments, the lower flashing seal 140 may further comprise a flexible, non-metal material.

Figure 4:
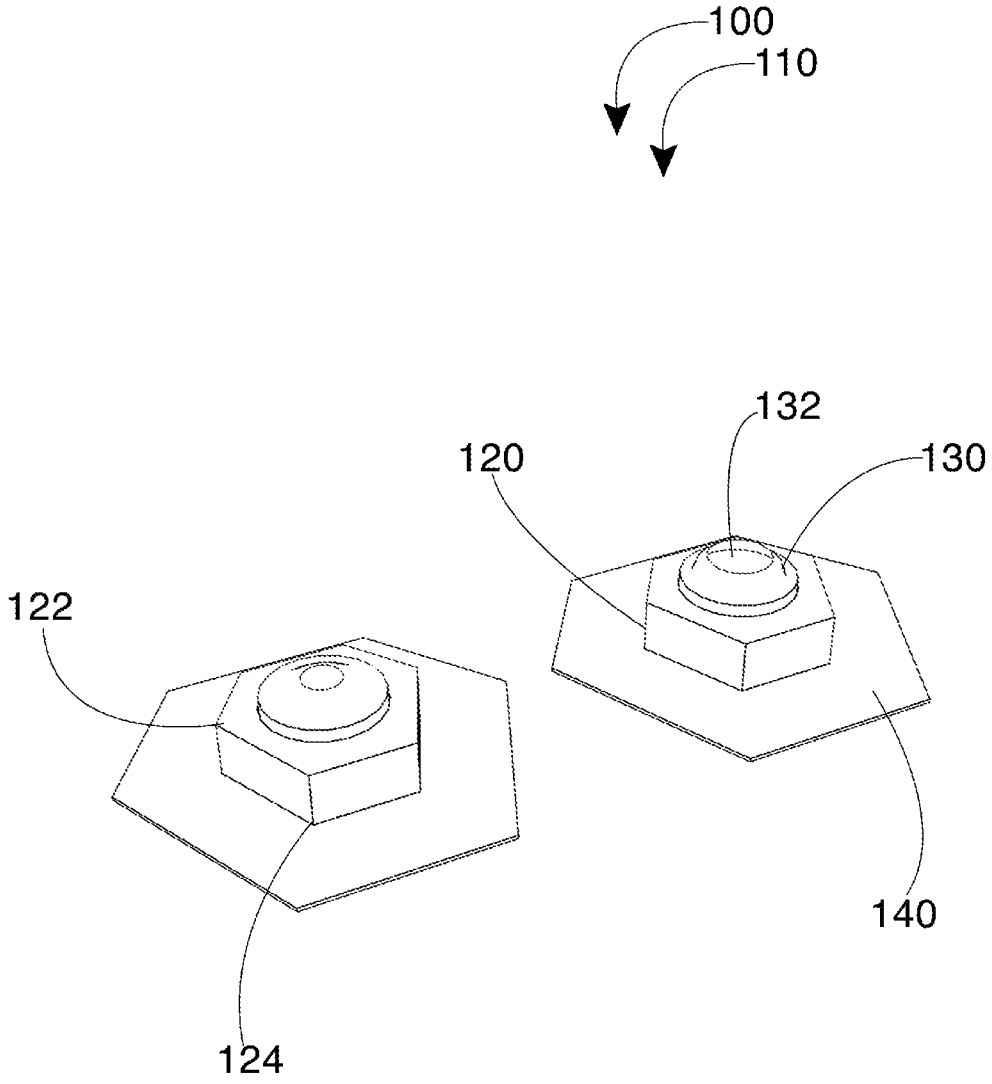
FIG. 4 is a perspective view of the metal roof flashing system of FIG. 1, according to an embodiment of the present disclosure.

FIG. 4 shows a perspective view of the metal roof flashing system 100 of FIG. 1, according to an embodiment of the present disclosure. As above, the metal roof flashing system 100 may include the pipe flashing assembly 110 including the triangular base flashing 120, the rubber vent support 130, and the lower flashing seal 140 to be installed on a roof surface 20. The lower flashing seal 140 is positioned underneath the roof surface 20 during an installed condition. The roof 20 may include a metal or a non-metal roof. Further, the pipe flashing assembly 110 may be installed to a sidewall of a building or location of a roof vent pipe 10. A method of installing the device is described hereafter.

Figure 5:
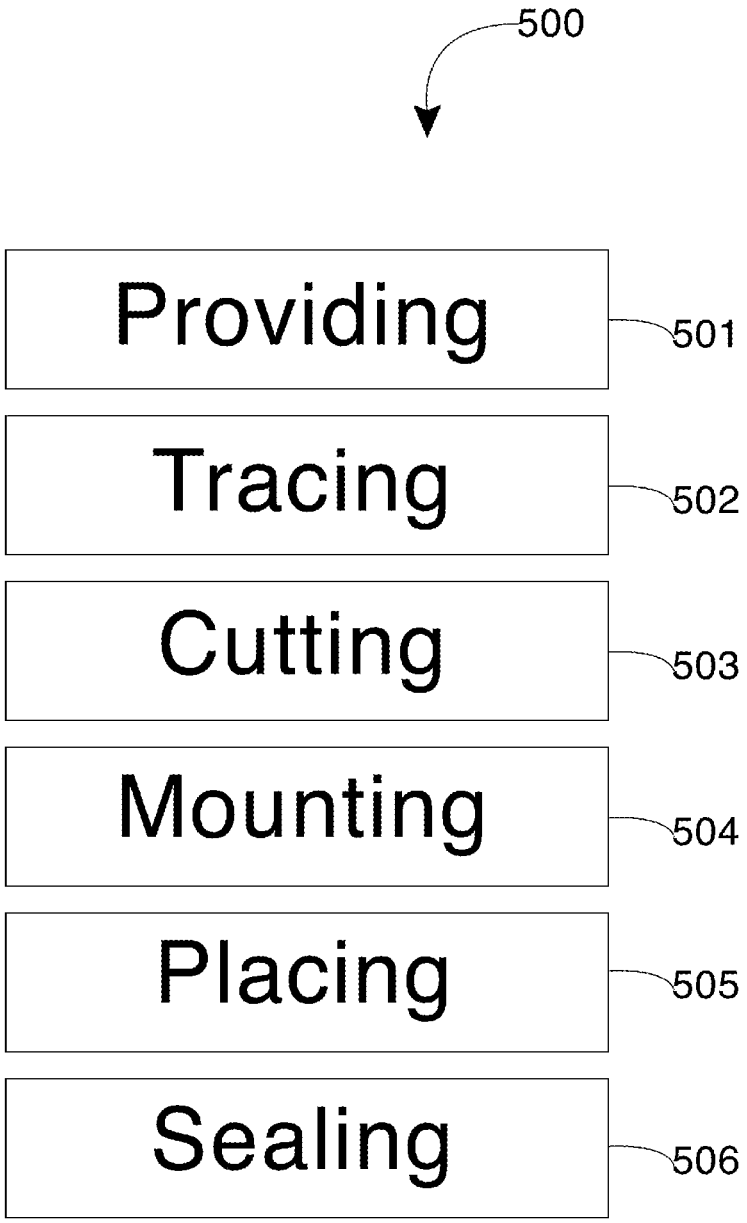
FIG. 5 is a flowchart describing a method of installing the metal roof flashing system of FIG. 1.

FIG. 5 is a flow diagram illustrating a method of installing a metal roof flashing system 500, according to an embodiment of the present disclosure. In particular, the method for installing a metal roof flashing system 500 may include one or more components or features of the metal roof flashing system 100 as described above. As illustrated, the method of installing a metal roof flashing system 500 may include the steps of: step one 501, providing a pipe flashing assembly 110 including a triangular base flashing 120, a rubber vent support 130, and a lower flashing seal 140; step two 502, tracing a profile of the triangular base flashing 120 on a roof covering; step three 503, cutting a traced profile from the roof covering; step four 504, mounting the pipe flashing assembly 110 to a roof surface 20; step five 505, placing a metal panel over the pipe flashing assembly 110; step six 506, sealing the metal panel to the pipe flashing assembly 110.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for installing a metal roof flashing system, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A metal roof flashing system comprising:

a pipe flashing assembly including;

a triangular base flashing having three edges whereby each intersection of the three edges are connected by a diagonal edge such that the triangular base comprises three flat-chamfered corners;

a rubber vent support; and a lower flashing seal;

wherein a sum of the lengths of the three edges of the triangular base is more than half of a perimeter of the triangular base;

wherein said lower flashing seal is affixed to said triangular base flashing and said rubber vent support is affixed to said triangular base flashing in respective order;

wherein said pipe flashing assembly is configured to receive a roof vent pipe and form a watertight seal around a plumbing vent stack on a roof surface;

wherein an aperture of said rubber vent support is flexible and configured to contour to and around said roof vent pipe and form a seal; and wherein said pipe flashing assembly is configured to be installed on said roof surface of a building.

2. The metal roof flashing system of claim 1, wherein said rubber vent support comprises a conical profile.

3. The metal roof flashing system of claim 2, wherein said rubber vent support is positioned at a top edge of said triangular base flashing.

4. The metal roof flashing system of claim 3, wherein said lower flashing seal is affixed to a bottom edge of said triangular base flashing, opposing said rubber vent support.

5. The metal roof flashing system of claim 4, wherein said lower flashing seal comprises a larger surface area than a base-surface-area of said triangular base flashing.

6. The metal roof flashing system of claim 5, wherein said lower flashing seal extends outwardly from said bottom edge of said triangular base flashing.

7. The metal roof flashing system of claim 1, wherein said triangular base flashing comprises a base-aperture in line with said aperture of said rubber vent support.

8. The metal roof flashing system of claim 1, wherein said rubber vent support is supported in an elevated position via said triangular base flashing.

9. The metal roof flashing system of claim 1, wherein said rubber vent support is deformable allowing said aperture to stretch and be applied to said roof vent pipe.

10. The metal roof flashing system of claim 1, wherein said rubber vent support is an integral vent collar.

11. The metal roof flashing system of claim 1, wherein said triangular base flashing comprises a metal material.

12. The metal roof flashing system of claim 1, wherein said lower flashing seal is planar.

13. The metal roof flashing system of claim 12, wherein said lower flashing seal comprises a metal material.

14. The metal roof flashing system of claim 12, wherein said lower flashing seal comprises a flexible, non-metal material.

15. The metal roof flashing system of claim 14, wherein said lower flashing seal is positioned underneath said roof surface during an installed condition.

16. The metal roof flashing system of claim 1, wherein said pipe flashing assembly is further configured to be applied to a sidewall of said building.

17. A metal roof flashing system, the metal roof flashing system comprising:

a pipe flashing assembly including;

a triangular base flashing having three edges whereby each intersection of the three edges are connected by a diagonal edge such that the triangular base comprises three flat-chamfered corners;

a rubber vent support; and a lower flashing seal;

wherein a sum of the lengths of the three edges of the triangular base is more than half of a perimeter of the triangular base;

wherein said lower flashing seal is affixed to said triangular base flashing and said rubber vent support is affixed to said triangular base flashing in respective order;

wherein said triangular base flashing comprises a metal material;

wherein said lower flashing seal comprises a metal material;

wherein said pipe flashing assembly is configured to receive a roof vent pipe and form a watertight seal around a plumbing vent stack on a roof surface;

wherein an aperture of said rubber vent support is flexible and configured to contour to and around said roof vent pipe and form a seal;

wherein said pipe flashing assembly is configured to be installed on said roof surface of a building;

wherein said lower flashing seal is positioned underneath said roof surface during an installed condition;

wherein said rubber vent support is an integral vent collar;

wherein said rubber vent support comprises a conical profile;

wherein said rubber vent support is deformable allowing said aperture to stretch and be applied to said roof vent pipe;

wherein said rubber vent support is positioned at a top edge of said triangular base flashing;

wherein said lower flashing seal is affixed to a bottom edge of said triangular base flashing, opposing said rubber vent support;

wherein said lower flashing seal comprises a larger surface area than a base-surface-area of said triangular base flashing;

wherein said lower flashing seal is planar;

wherein said lower flashing seal extends outwardly from said bottom edge of said triangular base flashing;

wherein said triangular base flashing comprises a base-aperture in line with said aperture of said rubber vent support;

wherein said rubber vent support is supported in an elevated position via said triangular base flashing.

18. A method of installing a metal roof flashing system, the method comprising the steps of:

providing the pipe flashing assembly of claim 1;

tracing a profile of said triangular base flashing on a roof covering;

cutting a traced profile from said roof covering;

mounting said pipe flashing assembly to a roof surface;

placing a metal panel over said pipe flashing assembly; and sealing said metal panel to said pipe flashing assembly.

* * * * *